United States Patent [19]

Oshima et al.

[11] Patent Number: 4,889,602

[45] Date of Patent: Dec. 26, 1989

[54] ELECTROPLATING BATH AND METHOD FOR FORMING ZINC-NICKEL ALLOY COATING

[75] Inventors: Katsuhide Oshima, Tokyo; Toshiaki Murai, Chiba; Hitoshi Sakurai, Matsudo; Shuji Igarashi, Hino; Haruo Hanagata, Ebina; Hidesato Igarashi, Tokyo, all of Japan

[73] Assignee: Dipsol Chemicals Co., Ltd., Tokyo, Japan

[21] Appl. No.: 186,788

[22] Filed: Apr. 25, 1988

Related U.S. Application Data

[63] Continuation-in-part of Ser. No. 37,863, Apr. 13, 1987, abandoned.

[30] Foreign Application Priority Data

Apr. 14, 1986 [JP] Japan ..... 61-85253
Jun. 4, 1986 [JP] Japan ..... 61-129447

[51] Int. Cl.[4] ..... C25D 3/56; C25D 5/48

[52] U.S. Cl. ..... 204/38.1; 204/44.2; 204/44.5

[58] Field of Search ..... 204/44.2, 44.5, 38.1

[56] References Cited

U.S. PATENT DOCUMENTS 4,417,956 11/1983 McCoy ..... 204/44
4,591,416 5/1986 Kamitani et al. ..... 204/35.1

FOREIGN PATENT DOCUMENTS 1421972 11/1968 Fed. Rep. of Germany ..... 204/44.2
51-28533 3/1976 Japan ..... 204/44.2
58-39236 8/1983 Japan ..... 204/44.2
59-185792 10/1984 Japan ..... 204/44.2
378546 7/1973 U.S.S.R. ..... 204/44.2
2144769 3/1985 United Kingdom .

OTHER PUBLICATIONS

A. V. Ryabchenkov et al., Translation from Zhurnal Prikladnoi Khimii, vol. 47, No. 7, pp. 1553–1558, Jul. 1974.

*Primary Examiner*—G. L. Kaplan
*Attorney, Agent, or Firm*—Frishauf, Holtz, Goodman & Woodward

[57] ABSTRACT

The invention provides an electroplating bath for forming a zinc-nickel alloy coating consisting essentially of water, about 1 to 70 grams/liter of zinc, about 0.6 to 118 grams per liter of nickel, at least one compound from the group consisting of (i) aliphatic amines in an amount not more than 16 grams/liter, (ii) polymers of aliphatic amines in an amount not more than about 20 grams per liter and (iii) a compound selected from the group consisting of hydroxyaliphatic carboxylic acids and salts thereof in an amount from 0 to 2 mols/liter, said bath having a pH of more than 11. The invention also provides an electroplating method for forming a chromate coating on a zinc-nickel alloy coating electrolytically deposited from the electroplating bath defined in the preceding sentence on electrically conductive metalics matrix material, and forming a chromate coating on the zinc-nickel alloy coating by means of a chromate treatment.

39 Claims, 2 Drawing Sheets

ELECTROPLATING BATH AND METHOD FOR FORMING ZINC-NICKEL ALLOY COATING

This application is a continuation-in-part of application Ser. No. 037,863 filed April 13, 1987 and now abandoned.

BACKGROUND OF THE INVENTION

1. Field of the Invention

The present invention relates to an electroplating bath for forming a zinc-nickel alloy coating on an electrically conductive metallic matrix and method for electroplating the same, more particularly to an electroplating bath and electroplating method employing an alkaline electroplating solution in which any cyanide is not included.

2. Description of the Prior Art

There has been known that zinc-nickel alloy is electroplated on metallic products in order to improve the corrosion resistance property thereof.

Conventionally, the zinc-nickel alloy electroplating process has been carried out in an acid electrolytic bath such as sulfate bath, chloride bath and sulfamate bath.

For example, in Japanese Patent Publication No. 58-39236, there is shown a method for electroplating the zinc-nickel alloy by employing an acid bath. In the case of the acid bath, it is advantageous that a high current efficiency can be obtained and the electroplating can be carried out under a high current density to reduce the processing time. This method can be effectively applied to products having a simple configuration such as steel plate and wire. However, for products having a complex configuration such as pressed products, welded parts and piping parts, the method employing the acid bath is disadvantageous in the fact that it is impossible to obtain a desirable homogeneity with regard to the thickness of the zinc-nickel alloy coating formed on the surface of the metallic products and a zinc-nickel alloy ratio which indicates a ratio of zinc and nickel contained in the coating.

There is shown an electroplating method employing a neutral bath in Japanese Patent Public Disclosure No. 59-185792. The method employing the neutral bath can improve the property of the zinc-nickel alloy coating formed on the product surface in comparison with the method employing the acid bath. There, however, occurs a problem that a large amount of complexing agent is needed for dissolving zinc and nickel so that a sophisticated drain processing unit is necessary for treating the complexing agent. In addition, it is disadvantageous in the fact that the solution in the bath becomes unstable because of the complexing agent.

In the method employing the neutral bath, a lot of chloride is commonly added in order to improve electrical conductivity. However, chloride has a high corrosive property so that the electroplating equipment and the electroplated product itself may be subjected to a corrosive action of chloride.

Further, there is shown an electroplating method employing an alkaline bath in Japanese Patent Public Disclosure No. 51-28533. In this method, a low corrosive electrolytic bath can be employed for electroplating. Therefore, it is advantageous in terms of the cost of the electroplating equipment in comparison with the methods employing the acid and neutral baths.

There, however, occurs a problem in the method employing the alkaline bath as disclosed in the Japanese Patent Public disclosure No. 51-28533 that cyanide is inevitably added for the alkaline bath so that the special drain processing unit has to be introduced for processing the cyanide contained in the solution because of high toxicity thereof. In addition, the working atmosphere is harmed.

SUMMARY OF THE INVENTION

It is, therefore, an object of the present invention to provide a stable electroplating bath having a low corrosive property.

It is another object of the present invention to provide an alkaline plating bath excluding cyanide giving wherein an alloy coating having an excellent homogeneity of the alloy ratio is obtained.

Another object of the present invention is to provide an alkaline plating bath through which a glossy zinc-nickel alloy coating can be obtained.

A still further object of the invention is to provide a method for electroplating zinc-nickel alloy on metallic products wherein a zinc-nickel alloy coating of an excellent homogeneity with regard to the alloy ratio can be formed by employing an alkaline bath excluding cyanide.

Yet another object of the invention is to provide an electroplating method for obtaining a bright zinc-nickel alloy coating on metallic products.

A still further object of the invention is to provide a corrosion resistant coating on metallic products.

The inventors of the present invention found that an electroplating process for zinc-nickel alloy coating can be successfully accomplished by utilizing an alkaline bath wherein at least one kind of hydroxy-aliphatic carboxylic acids or salts thereof and at least one kind of aliphatic amines are added to the electroplating solution excluding cyanide.

According to the present invention, the above and other objects of the invention can be accomplished by an electroplating bath for zinc-nickel alloy coating including at least one kind of hydroxy-aliphatic carboxylic acids or salts thereof and/or at least one kind of aliphatic amines or polymers thereof wherein the bath has a pH of more than 11.

The invention provides an electroplating bath for forming a zinc-nickel alloy coating consisting essentially of water, about 1 to 70 grams/liter of zinc, about 0.6 to 118 grams per liter of nickel, at least one compound from the group consisting of (i) aliphatic amines in an amount not more than 16 grams/liter, (ii) polymers of aliphatic amines in an amount not more than about 20 grams per liter and (iii) a compound selected from the group consisting of hydroxyaliphatic carboxylic acids and salts thereof in an amount from 0 to 2 mols/liter, said bath having a pH of more than 11. The invention also provides an electroplating method for forming a chromate coating on a zinc-nickel alloy coating electrolytically deposited from the electroplating bath defined in the preceding sentence on electrically conductive metallic matrix material, and forming a chromate coating on the zinc-nickel alloy coating by means of a chromate treatment.

Preferably, the electroplating bath further includes at least one kind of aromatic aldehydes.

The electrolytic solution according to the present invention contains electrolytes such as NaOH, KOH, $Na_2CO_3$, and $K_2CO_3$ in the range of 1 to 300 g/liter. The electrolytic solution further includes zinc containing compounds such as ZnO, $ZnSO_46H_2O$, $ZnCO_3$, $Zn(CH_3COO)_2$ and nickel containing compounds such as $NiSO_46H_2O$, $NiCO_3$, $(NH_4)_2Ni(SO_4)_26H_2O$. It is preferable that the zinc and nickel containing compounds are added to the electrolytic solution so that the concentrations of zinc and nickel range from 1 to 70 g/liter and from 0.6 to 118 g/liter respectively.

When hydroxy-aliphatic carboxylic acids or salts thereof are added to the solution, they are preferably added in the range of one-fourth to ten times the amount of nickel in the molar concentration; in other words, 0.01 to 2.0 mole/liter. Typical hydroxy-aliphatic carboxylic acids or the salts include tartaric acid, sodium tartrate, citric acid, sodium citrate, disodium citrate, glycolic acid, and sodium glycolate. Typical aliphatic amines include monoethanolamine, diethanolamine, triethanolamine, ethylenediamine, diethylenetriamine, imino-bis-propylamine, triethylenetetramine, tetraethylenepentamine, hexamethylenediamine, N,N'-bis-(triaminopropyl)ethylenediamine, and the like. Typical aliphatic amine polymer include polyethyleneimine available from Badish Corporation as trademark of (Polyethyleneimine G-35), and (Epomine SP, Epomine P-1000) available from Nippon Shokubai Kagaku Kogyo Co., Ltd. Further tertiary or quarternary amine polymers as shown by the following structural formula (1) may be used.

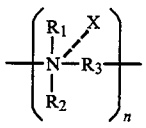

(1)

$R_1$, $R_2$: H, $CH_3$, $C_2H_5$, $C_3H_7$
$R_3$: (1)$CH_2-CH_2-CH_2$ (2)$CH_2-CH(OH)-CH_2$ (3)$CH_2CH_2-O-CH_2CH_2$
(4)$CH_2-O-CH_2$ (5)$CH_2-CH(CH_3)-CH_2$ (6)$CH_2-CH(OH)-CH(OH)$ (7)$CH_2CH_2-C(OH)-CH$ (8)$CH_2-CH(CH_3)-CH(OH)$ $X_1$, $X_2$: inorganic anion
n: 10 to 200

Typical aromatic aldehydes added to the solution as a gloss agent (i.e., brightener) include vanillin, anisealdehyde, piperonal, veratraldehyde, salicylaldehyde, benzaldehyde, P-tolualdehyde and the like. In this case, preferably, one or more of the aldehydes are added to the solution.

It is preferable that more than 0.03 mole/liter of the aliphatic amines are added to the solution.

According to the present invention, firstly, the electrolytes such as NaOH, KOH, $Na_2CO_3$, $K_2Co_3$, and the like and the zinc containing compounds such as ZnO, $ZnSO_47H_2O$, $ZnCO_3$, $Zn(CH_3COO)_2$, and the like are dissolved to prepare a zincate solution. While, at least one kind of nickel containing compounds such as $NiSO_46H_2O$, $NiCO_3$, $(NH_4)_2Ni(SO_4)_26H_2O$ and the like are dissolved to prepare a solution. Thereafter the zincate solution and the solution containing nickel are mixed to prepare an electroplating solution wherein the concentrations of salts are determined in accordance with the alloy ratio between zinc and nickel required in the alloy coating formed on the metallic products.

Typical metallic products include steel, copper, copper alloy, and aluminum alloy.

Preferably, a chromate treatment is applied to the zinc-nickel alloy coating electro-deposited on the metallic products so that the corrosion resistance can be further improved. The chromate coating may have a color, such as blue, yellow, green, black and the like by employing an appropriate colorant during the chromate treatment.

According to the present invention, a zinc-nickel alloy coating formed on steel products has a fine homogeneity of the alloy ratio throughout the coating. This is true even in a steel product of a complicated configuration.

Further, the zinc-nickel alloy coating obtained through the method according to the present invention has a homogeneous electrolytic deposition property so that the coating is homogeneous in thickness throughout the electroplated portion and has a good brightness. Moreover, the electroplating bath excludes cyanide to prevent deterioration of the working environment. The electroplating bath of the present invention is of an alkali so that the corrosive property is low in comparison with acidic and neutral baths resulting of low cost in equipment.

DESCRIPTION OF THE PREFERRED EMBODIMENTS

EXAMPLE 1

Figure 1:
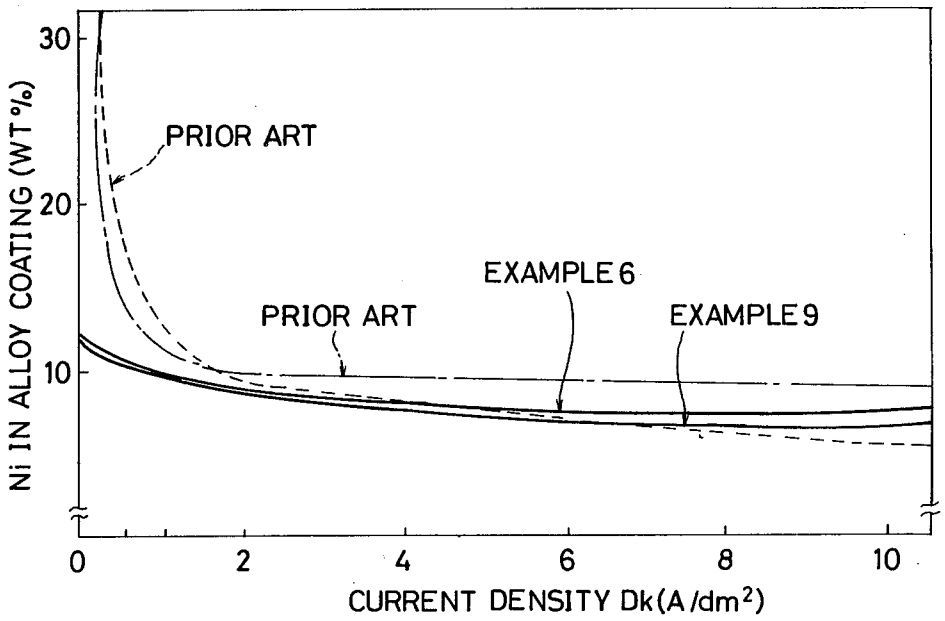
FIG. 1 is a graph showing a relationship between nickel contained in the alloy coating and the current density.

The electroplating bath was prepared in accordance with the following conditions.

Components of the electroplating bath
ZnO: 15.6 g/liter
$NiSO_46H_2O$: 12 g/liter
NaOH: 120 g/liter
Sodium tartrate: 10 g/liter
Tertiary or quarternary aminepolymers shown by the structural formula (1): 1 g/liter
Brightener: 0.03 g/liter
Zn/Ni: 83/17
pH: >14.0
Bath temperature: 30° C.
Operation time: 10 minutes.

The zinc-nickel alloy electroplated coating was obtained under the above conditions on the surface of iron product. The coating has a fine brightness and is homogenous in thickness.

EXAMPLE 2

The electroplating bath was prepared in accordance with the following conditions.

Components of the electroplating bath
ZnO: 6.5 g/liter
$NiSO_46H_2O$: 47.5 g/liter
NaOH: 100 g/liter
Sodium tartrate: 32 g/liter
Tetraethylenepentamine: 2 g/liter
Brightener: 0.05 g/liter
Zn/Ni: 33/67
pH: >14.0
Bath temperature: 30° C.
Operation time: 10 minutes.

The zinc-nickel alloy electroplated coating was obtained under the above conditions on the surface of iron product. The coating has a fine brightness, specifically in the range of the current density of 0.2 to 5 $A/dm_2$ and is homogenous in thickness.

EXAMPLE 3

The electroplating bath was prepared in accordance with the following conditions.

Components of the electroplating bath
$ZnSO_47H_2O$: 15.6 g/liter
$NiSO_46H_2O$: 12 g/liter
NaOH: 100 g/liter
Sodium tartrate: 10 g/liter
Disodium citrate: 11 g/liter
Polyethylene-imine G-35: 0.35 g/liter
Brightener: 0.03 g/liter
Zn/Ni: 83/17
pH: approximately 13.0
Bath temperature: 40° C.
Operation time: 10 minutes.

The zinc-nickel alloy electroplated coating was obtained under the above conditions on the surface of iron product. The coating has a fine brightness and is homogenous in thickness.

EXAMPLE 4

The electroplating bath was prepared in accordance with the following conditions.

Components of the electroplating bath
ZnO: 6.5 g/liter
$(NH_4)_2Ni(SO_4)_26H_2O$: 47.5 g/liter
KOH: 90 g/liter
Sodium gylcolate: 20 g/liter
Tetraethylenepentamine: 5 g/liter
Brightener: 0.05 g/liter
Zn/Ni: 50/50
pH: >14.0
Bath temperature: 30° C.
Operation time: 10 minutes.

The zinc-nickel alloy electroplated coating was obtained under the above conditions on the surface of iron product. The coating has a fine brightness and is homogenous in thickness.

EXAMPLE 5

The electroplating bath was prepared in accordance with the following conditions.

Components of the electroplating bath
ZnO: 6.5 g/liter
$NiSO_46H_2O$: 47.5 g/liter
NaOH: 20 g/liter
Sodium gluconate: 46 g/liter
Polyethylene-imine SP003: 0.2 g/liter
Brightener: 0.1 g/liter
Zn/Ni: 33/67
pH: approximately 12.5
Bath temperature: 25° C.
Operation time: 10 minutes.

The zinc-nickel alloy electroplated coating was obtained under the above conditions on the surface of iron product. The coating has a fine brightness and is homogenous in thickness.

EXAMPLE 6

The electroplating bath was prepared in accordance with the following conditions.

Components of the electroplating bath
ZnO: 6.5 g/liter
$NiSO_46H_2O$: 47.5 g/liter
NaOH: 150 g/liter
Sodium citrate: 46 g/liter
Sodium tartrate: 30 g/liter
Polyethylene-imine SP003: 0.2 g/liter
Brightener: 0.1 g/liter
Zn/Ni: 33/67
pH: >14.0
Bath temperature: 30° C.
Operation time: 10 minutes.

The zinc-nickel alloy electroplated coating was obtained under the above conditions on the surface of iron product. The coating has a fine brightness and is homogenous in thickness.

EXAMPLE 7

The electroplating bath was prepared in accordance with the following conditions.

Components of the electroplating bath
ZnO: 18.8 g/liter
$NiSO_46H_2O$: 22.4 g/liter
NaOH: 150 g/liter
Sodium tartrate: 12.8 g/liter
Triethanolamine: 12.8 g/liter
tertiary or quarternary amine polymer: 1 g/liter
Brightener: 0.1 g/liter
Zn/Ni: 75/25
pH: >14.0
Bath temperature: 30° C.
Operation time: 10 minutes.

The zinc-nickel alloy electroplated coating was obtained under the above conditions on the surface of iron product. The coating has a fine brightness and is homogenous in thickness.

EXAMPLE 8

The electroplating bath was prepared in accordance with the following conditions.

Components of the electroplating bath
ZnO: 9.5 g/liter(7.5 g/liter as Zn)
$NiSO_46H_2O$: 12 g/liter(1.5 g/liter as Ni)
NaOH: 120 g/liter
Triethylenetetramine: 7.5 g/liter
Brightener: 0.01 g/liter
Zn/Ni: 83/17
pH: >14.0
Bath temperature: 30° C.
Operation time: 10 minutes.

The zinc-nickel alloy electroplated coating was obtained under the above conditions on the surface of iron product. The coating has a fine brightness and is homogenous in thickness.

EXAMPLE 9

The electroplating bath was prepared in accordance with the following conditions.

Components of the electroplating bath
ZnO: 11.3 g/liter(9.0 g/liter as Zn)
$NiSO_46H_2O$: 4.1 g/liter(1.0 g/liter as Ni)
NaOH: 120 g/liter
Polyethylene-imine SP103: 5.1 g/liter (Molecular weight 300)
Zn/Ni: 90/10
pH: >14.0
Bath temperature: 30° C.
Operation time: 10 minutes.

The zinc-nickel alloy electroplated coating was obtained under the above conditions on the surface of iron product. The coating has a fine brightness, specifically in the range of the current density of 0.2 to 5 $A/dm^2$ and is homogenous in thickness.

EXAMPLE 10

The electroplating bath was prepared in accordance with the following conditions.

Components of the electroplating bath
$ZnSO_47H_2O$: 60 g/liter(13.5 g/liter as Zn)
$NiSO_46H_2O$: 6.7 g/liter(1.5 g/liter as Ni)
NaOH: 150 g/liter
1,18-diamino-4,8,11,15-tetra-aso-octadecane: 7.5 g/liter(Molecular weight 288.5)
Brightener: 0.01 g/liter
Zn/Ni: 90/10
pH: >14.0
Bath temperature: 25° C.
Operation time: 10 minutes.

The zinc-nickel alloy electroplated coating was obtained under the above conditions on the surface of iron product. The coating has a fine brightness and is homogenous in thickness.

EXAMPLE 11

The electroplating bath was prepared in accordance with the following conditions.

Components of the electroplating bath
ZnO: 11.3 g/liter(9.0 g/liter as Zn)
$(NH_4)_2Ni(SO_4)_26H_2O$: 11.3 g/liter(1.0 g/liter as Ni)
KOH: 90 g/liter
Triethanolamine: 5.1 g/liter
Polyethylene-imine SP003: 2.5 g/liter
Brightener: 0.02 g/liter
Zn/Ni: 90/10
pH: >14.0
Bath temperature: 30° C.
Operation time: 10 minutes.

The zinc-nickel alloy electroplated coating was obtained under the above conditions on the surface of iron product. The coating has a fine brightness and is homogenous in thickness.

EXAMPLE 12

The electroplating bath was prepared in accordance with the following conditions.

Components of the electroplating bath
ZnO: 19.0 g/liter(15.0 g/liter as Zn)
$NiCl_26H_2O$: 10.0 g/liter(2.5 g/liter as Ni)
NaOH: 150 g/liter
Tetraethylenepentamine: 16.0 g/liter
Tertiary or quarternary amine polymer as shown by the structural formula (1) 20 g/liter(Molecular weight 800)
Zn/Ni: 90/10
pH: >14.0
Bath temperature: 25° C.
Operation time: 10 minutes.

The zinc-nickel alloy electroplated coating was obtained under the above conditions on the surface of iron product. The coating has a fine brightness and is homogenous in thickness.

COMPARATIVE EXAMPLE 1

A zinc-nickel alloy electroplated coating was obtained through conventional electroplating method under the following conditions.

Components of the electroplating bath
$ZnCl_2$: 100 g/liter
$NiCl_26H_2O$: 120 g/liter
$NH_4Cl$: 220 g/liter
Brightener(commercially available) 50 g/liter
Zn/Ni: 61/39
pH: 5.8
Bath temperature: 35° C.
Operation time: 10 minutes.

The zinc-nickel alloy electroplated coating was obtained under the above conditions on the surface of iron product. The alloy ratio of the coating changes in accordance with the current density.

COMPARATIVE EXAMPLE 2

A zinc-nickel alloy electroplated coating was obtained through conventional electroplating method under the following conditions.

Components of the electroplating bath
Zinc-cyanide: 100 g/liter
Nickel potassium cyanide 35 g/liter
NaOH: 40 g/liter
Zn/Ni: 37/63
pH: >14
Bath temperature: 60° C.
Operation time: 10 minutes.

The zinc-nickel alloy electroplated coating was obtained under the above conditions on the surface of iron product. The alloy ratio of the coating substantially changes in accordance with the current density. When the current density reduces below 0.5 $A/dm^2$, the thickness of the coating is steeply decreased.

TABLE 1

| | | CURRENT DENSITY $D_K$ ($A/dm^2$) | | | | | |
|---|---|---|---|---|---|---|---|
| | | 10 | 5 | 2 | 1 | 0.5 | 0.2 |
| EXAMPLE 1 | COATING THICKNESS (μm) | 12.3 | 8.5 | 4.4 | 2.7 | 1.8 | 0.8 |
| | ALLOY RATIO (Zn/Ni) | 98.2/ 1.8 | 98.1/ 1.9 | 98.0/ 2.0 | 98.0/ 2.0 | 97.8/ 2.2 | 97.6/ 2.4 |
| EXAMPLE 2 | COATING THICKNESS (μm) | 10.9 | 8.1 | 4.0 | 2.2 | 1.5 | 0.7 |

TABLE 1-continued

| | | CURRENT DENSITY $D_K$ (A/dm$^2$) | | | | | |
|---|---|---|---|---|---|---|---|
| | | 10 | 5 | 2 | 1 | 0.5 | 0.2 |
| EXAMPLE 3 | ALLOY RATIO (Zn/Ni) | 87.7/ 12.3 | 87.3/ 12.3 | 87.5/ 12.5 | 87.4/ 12.6 | 87.2/ 12.8 | 87.0/ 13.0 |
| | COATING THICKNESS (μm) | 13.2 | 9.8 | 4.8 | 3.0 | 1.9 | 0.7 |
| EXAMPLE 4 | ALLOY RATIO (Zn/Ni) | 99.3/ 0.7 | 99.3/ 0.7 | 99.3/ 0.7 | 99.2/ 0.8 | 99.2/ 0.8 | 99.0/ 1.0 |
| | COATING THICKNESS (μm) | 11.9 | 8.4 | 4.1 | 2.5 | 1.6 | 0.8 |
| EXAMPLE 5 | ALLOY RATIO (Zn/Ni) | 92.8/ 7.2 | 92.8/ 7.2 | 92.8/ 7.2 | 92.4/ 7.6 | 92.6/ 7.4 | 92.3/ 7.7 |
| | COATING THICKNESS (μm) | 12.2 | 8.3 | 3.8 | 2.0 | 1.3 | 0.6 |
| EXAMPLE 6 | ALLOY RATIO (Zn/Ni) | 92.1/ 7.9 | 92.0/ 8.0 | 92.0/ 8.0 | 91.8/ 8.2 | 91.5/ 8.5 | 91.1/ 8.9 |
| | COATING THICKNESS (μm) | 12.0 | 8.1 | 4.0 | 2.2 | 1.4 | 0.7 |
| EXAMPLE 7 | ALLOY RATIO (Zn/Ni) | 93.5/ 6.5 | 92.4/ 7.6 | 91.2/ 8.8 | 90.5/ 9.5 | 90.0/ 10.0 | 89.7/ 10.3 |
| | COATING THICKNESS (μm) | 12.6 | 8.8 | 4.6 | 2.5 | 1.4 | 0.6 |
| EXAMPLE 8 | ALLOY RATIO (Zn/Ni) | 94.7/ 5.3 | 94.0/ 6.0 | 93.8/ 6.2 | 93.5/ 6.5 | 92.5/ 7.5 | 92.0/ 8.3 |
| | COATING THICKNESS (μm) | 9.4 | 7.1 | 3.7 | 2.0 | 1.2 | 0.5 |
| EXAMPLE 9 | ALLOY RATIO (Zn/Ni) | 80.1/ 19.9 | 79.3/ 20.7 | 79.2/ 20.8 | 79.2/ 20.8 | 78.0/ 22.0 | 75.0/ 25.0 |
| | COATING THICKNESS (μm) | 10.1 | 7.8 | 4.0 | 2.1 | 1.2 | 0.5 |
| EXAMPLE 10 | ALLOY RATIO (Zn/Ni) | 91.8/ 8.2 | 91.5/ 8.5 | 91.0/ 9.0 | 91.5/ 9.5 | 89.8/ 10.2 | 89.0/ 11.0 |
| | COATING THICKNESS (μm) | 10.0 | 7.6 | 4.0 | 2.2 | 1.2 | 0.5 |
| EXAMPLE 10 | ALLOY RATIO (Zn/Ni) | 91.0/ 9.0 | 90.5/ 9.5 | 90.0/ 10.0 | 90.0/ 10.0 | 89.3/ 10.7 | 88.1/ 11.9 |
| | COATING THICKNESS (μm) | 9.8 | 7.7 | 4.0 | 2.0 | 1.2 | 0.5 |
| EXAMPLE 10 | ALLOY RATIO (Zn/Ni) | 89.8/ 10.2 | 89.2/ 10.8 | 89.0/ 11.0 | 88.6/ 11.4 | 88.1/ 11.9 | 87.0/ 13.0 |
| | COATING THICKNESS (μm) | 11.2 | 8.3 | 4.1 | 2.3 | 1.2 | 0.5 |
| COMPARATIVE EXAMPLE 1 | ALLOY RATIO (Zn/Ni) | 86.9/ 13.1 | 86.2/ 13.8 | 85.8/ 14.2 | 85.5/ 14.5 | 85.0/ 15.0 | 84.0/ 16.0 |
| | COATING THICKNESS (μm) | 26.0 | 12.6 | 6.0 | 4.2 | 2.0 | 1.6 |
| COMPARATIVE EXAMPLE 2 | ALLOY RATIO (Zn/Ni) | 91.0/ 9.0 | 91.0/ 9.0 | 90.0/ 10.0 | 90.0/ 10.0 | 86.0 14.0 | 72.0/ 18.0 |
| | COATING THICKNESS (μm) | 9.0 | 4.9 | 4.8 | 4.2 | 0.1 | 0.01 |
| | ALLOY RATIO (Zn/Ni) | 94.7/ 5.0 | 91.8/ 8.2 | 90.4/ 9.6 | 87.9/ 12.1 | 81.7/ 18.3 | 68.2/ 31.8 |

According to Table 1, there is shown the changes of the alloy ratio which indicates ratio between zinc and nickel in the electrolytically deposited coatings formed on steel products. It will be understood that the coatings obtained through the method in accordance with the present invention are substantially homogeneous in the alloy ratio.

FIG. 1 shows a relationship between the amount of nickel contained in the alloy coatings deposited on the steel products and the current density. It should be noted that the amount of nickel in the alloy coating is greatly increased in accordance with reduction of the current density in the conventional alloy coating. On the other hand, there is no substantial change of the amount of the nickel in the alloy coatings obtained in accordance with the present invention irrespective of reduction of the current density.

Figure 2:
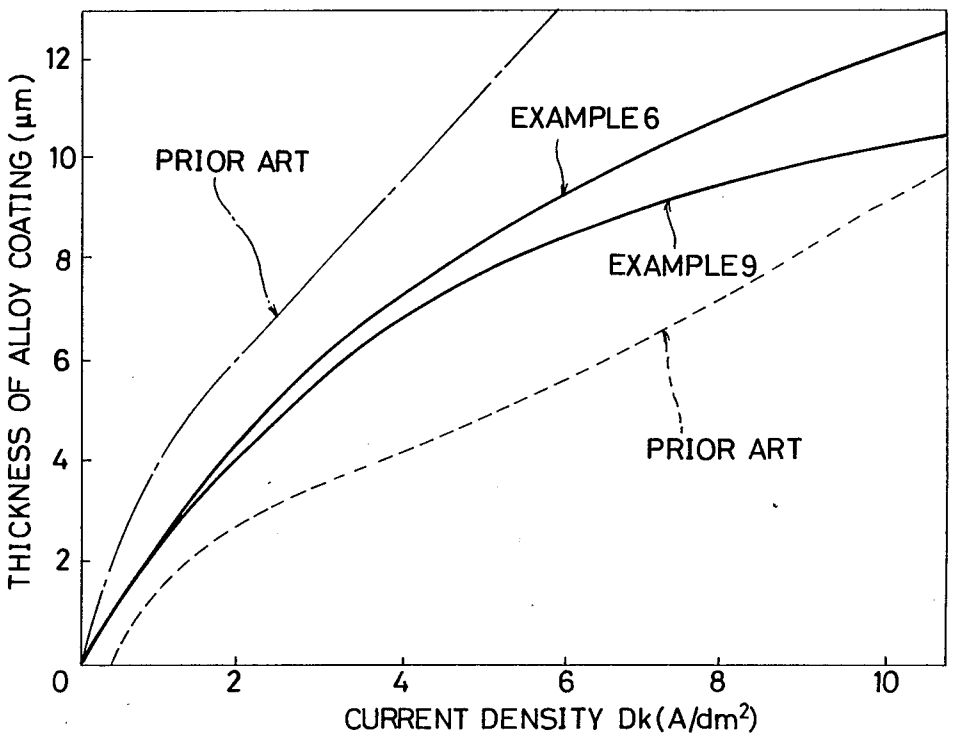
FIG. 2 is a graph showing a relationship between the thickness of the alloy coating and the current density.

In FIG. 2, there is shown a relationship between the thickness of the alloy coating and the current density. In the alloy coating according to the present invention, the thickness of the coating changes substantially proportional to the current density. However, in the conventional alloy coating, there is a big difference in the thickness of the coating between high and low current densities.

In Table 2, there is shown a result of the salt spray test for examining corrosion resistance with regard to a sample 1, 2 and 3 in accordance with Japanese Industrial Standards. The result shows the time period until the corrosion occurs after starting the test.

Sample 1 was prepared by applying chromate treatment to the metallic product formed with the zinc-nickel alloy coating in accordance with example 9. On the other hand, samples 2 and 3 were prepared by applying chromate treatment to the product with the zinc-nickel alloy coatings in accordance with the comparative examples 1 and 2 respectively.

TABLE 2

| | EXAMPLE 9 | | | | COMPARATIVE EXAMPLE 1 | | COMPARATIVE EXAMPLE 2 | | |
|---|---|---|---|---|---|---|---|---|---|
| $D_K$ | 3.0 A/dm$^2$ | | | | 4.0 A/dm$^2$ | | 4.0 A/dm$^2$ | | |
| Time | 15 min. | | | | 12 min. | | 15 min. | | |
| Temp. | 30° C. | | | | 35° C. | | 60° C. | | |
| CHROMATE COATING | BLUE | YELLOW | GREEN | BLACK | BLUE | YELLOW | YELLOW | GREEN | BLACK |
| SALT SPRAY TEST (Hrs) | 1,080 | 1,200 | 1,920 | 1,728 | 240 | 360 | 120 | 48 | 48 |

According to Table 2, the chromate coating in accordance with the present invention has a high corrosion resistant property in comparison with that of the conventional method. Further, the electroplating bath and method in accordance with the present invention are advantageous that the resultant coating has a fine homogeneity in the alloy ratio and thickness, in other words, the coating is stable irrespective of changes of the current density so that the method can be applied effectively even for products of complicated configuration.

We claim:

1. An electroplating bath for forming a zinc-nickel alloy coating consisting essentially of water, about 1 to 70 grams/liter of zinc, about 0.6 to 118 grams per liter of nickel, at least one component from the group consisting of (i) aliphatic amines in an amount not more than 16 grams/liter (ii) polymers of aliphatic amines in an amount not more than about 20 grams per liter, said at least one component being in an effective amount so that the electrodeposited zinc-nickel alloy coating electrodeposited from said bath has a substantially uniform zinc-nickel alloy ratio, said bath having a pH of more than 11.

2. The electroplating bath of claim 1 wherein said bath also contains at least one hydroxyaliphatic carboxylic acid selected from the group consisting of tartaric acid, sodium tartrate, citric acid, sodium citrate, disodium citrate, glycolic acid and sodium glycolate or a salt thereof in an amount of from 0.01 to 2 mols/liter.

3. The electroplating bath of claim 2 wherein zinc is in an amount of 1 to 70 g/liter and nickel is in an amount of 0.6 to 118 g/liter;

said bath contains at least one compound selected from the group consisting of NaOH, KOH, $Na_2CO_3$ and $K_2CO_3$ in an amount of 1 to 300 g/liter; and said bath contains at least one aliphatic amine selected from the group consisting of monoethanolamine, diethanolamine, triethanolamine, ethylenediamine, diethylenetriamine, imino-bis-propylamine, triethylenetetramine, tetraethylenepentamine, hexamethylenediamine, and N,N'-bis-(triaminopropyl) ethylenediamine or a polymer thereof.

4. The electroplating bath of claim 3 wherein said bath also contains at least one aromatic aldehyde in an amount effective as a brightening agent.

5. The electroplating bath of claim 4 wherein said pH is at least 14.

6. The electroplating bath of claim 5 wherein zinc is added as a component selected from the group consisting of ZnO, $ZnSO_47H_2O$, $ZnCO_3$ and $Zn(CH_3COO)_2$, and said nickel is added as a component from the group consisting of $NiSO_46H_2O$, $NiCO_3$ and $(NH_4)_2Ni(SO_4)_26H_2O$.

7. The electroplating bath of claim 2 wherein the minimum amount of said aliphatic amines (i) or polymers thereof (ii) is 0.03 mol/liter.

8. The electroplating bath of claim 1 wherein said bath contains at least one aliphatic amine selected from the group consisting of monoethanolamine, diethanolamine, triethanolamine, ethylenediamine, diethylenetriamine, imino-bis-propylamine, triethylenetetramine, tetraethylenepentamine, hexamethylenediamine, and N,N'-bis-(triaminopropyl) ethylenediamine or a polymer thereof.

9. The electroplating bath of claim 1 wherein said bath also contains at least one aromatic aldehyde in an amount effective as a brightening agent.

10. The electroplating bath of claim 1 wherein said bath contains at least one compound selected from the group consisting of NaOH, KOH, $Na_2CO_3$ and $K_2CO_3$ in an amount of 1 to 300 g/liter.

11. The electroplating bath of claim 1 wherein zinc is added as a component selected from the group consisting of ZnO, $ZnSO_47H_2O$, $ZnCO_3$ and $Zn(CH_3COO)_2$ in an amount of 1 to 70 g/liter of zinc, and said nickel is added as a component from the group consisting of $NiSO_46H_2O$, $NiCO_3$ and $(NH_4)_2Ni(SO_4)_26H_2O$ in an amount of 0.6 to 118 g/liter of nickel.

12. The electroplating bath of claim 1 wherein said pH is at least 14.

13. The electroplating bath of claim 1 wherein the bath contains at least one of said aliphatic amines (i) or polymers thereof (ii) in an amount of at least 0.03 mol/liter.

14. The electroplating bath of claim 1 consisting essentially of water, about 1 to 70 grams/liter of zinc, about 0.6 to 118 grams/liter of nickel, and at least one compound from the group consisting of (i) aliphatic amines in an amount not more than 16 grams/liter, said bath having a pH of more than 11.

15. The electroplating bath of claim 1 consisting essentially of water, about 1 to 70 grams/liter of zinc, about 0.6 to 118 grams/liter of nickel, and at least one compound from the group consisting of (ii) polymers of aliphatic amines in an amount not more than about 20 grams/liter, said bath having a pH of more than 11.

16. The electroplating bath of claim 1 consisting essentially of water, about 1 to 70 grams/liter of zinc, about 0.6 to 118 grams/liter of nickel, (i) aliphatic amines in an amount not more than 16 grams/liter and (ii) polymers of aliphatic amines in an amount not more than about 20 grams/liter, said bath having a pH of more than 11.

17. The electroplating bath of claim 1 consisting essentially of water, about 1 to 70 grams/liter of zinc, about 0.6 to 118 grams/liter of nickel, at least one compound from the group consisting of (i) aliphatic amines in an amount not more than 16 grams/liter, and (ii) polymers of aliphatic amines in an amount not more than about 20 grams/liter, and a compound from the group consisting of (iii) hydroxyaliphatic carboxylic acids and salts thereof in an amount from 0.01 to 2 mols/liter, said bath having a pH of more than 11.

18. The electroplating method for forming a zinc-nickel alloy coating on an electrically conductive metallic matrix material comprising electrolytically depositing a zinc-nickel alloy coating on the matrix material from an electroplating bath consisting essentially of water, about 1 to 70 grams/liter of zinc, about 0.6 to 118 grams per liter of nickel, at least one component from the group consisting of (i) aliphatic amines in an amount not more than 16 grams/liter, (ii) polymers of aliphatic amines in an amount not more than about 20 grams per liter and (iii) a compound selected from the group consisting of hydroxyaliphatic carboxylic acids and salts thereof in amount not more than 2 mols/liter, said at least one component being in an effective amount so that the electrodeposited zinc-nickel alloy coating electrodeposited from said bath has a substantially uniform zinc-nickel alloy ratio, said bath having a pH of more than 11.

19. The electroplating method of claim 18 wherein said metallic matrix is selected from the group consisting of steel, copper, copper alloys and aluminum alloys.

20. The electroplating method of claim 18 wherein said bath contains said hydroxyaliphatic carboxylic acid in an amount of at least 0.01 mol/liter 21. The electroplating method of claim 20 wherein said bath contains at least one hydroxyaliphatic carboxylic acid selected from the group consisting of tartaric acid, sodium tartrate, citric acid, sodium citrate, disodium citrate, glycolic acid and sodium glycolate or a salt thereof.

22. The electroplating method of claim 21 wherein zinc is in an amount of 1 to 70 g/liter and nickel is in an amount of 0.6 to 118 g/liter;

said bath contains at least one compound selected from the group consisting of NaOH, KOH, $Na_2CO_3$ and $K_2CO_3$ in an amount of 1 to 300 g/liter; and said bath contains at least 0.03 mol per liter of at least one aliphatic amine selected from the group consisting of monoethanolamine, monoethanolamine, diethanolamine, triethanolamine, ethylenediamine, diethylenetriamine, imino-bis-propylamine, triethylenetetramine, tetraethylenepentamine, hexamethylenediamine, and N,N'-bis-(triaminopropyl) ethylenediamine or polymer thereof.

23. The electroplating method of claim 22 wherein said bath also contains at least one aromatic aldehyde in an amount effective as a brightening agent.

24. The electroplating method of claim 23 wherein said pH is at least 14.

25. The electroplating method of claim 24 wherein zinc is added as a component selected from the group consisting of at least one ZnO, $ZnSO_47H_2O$, $ZnCO_3$ and $Zn(CH_3COO)_2$, and said nickel is added as a component from the group consisting of $NiSO_46H_2O$, $NiCO_3$ and $(NH_4)_2Ni(SO_4)_26H_2O$.

26. The electroplating method of claim 18 wherein said bath contains said aliphatic amine or polymer thereof in an amount of at least 0.03 mol/liter.

27. The electroplating method of claim 26 wherein said bath contains at least one aliphatic amine selected from the group consisting of monoethanolamine, diethanolamine, triethanolamine, ethylenediamine, diethylenetriamine, imino-bis-propylamine, triethylenetetramine, tetraethylenepentamine, hexamethylenediamine, and N,N'-bis-(triaminopropyl) ethylenediamine or polymer thereof.

28. The electroplating method of claim 18 wherein said bath also contains at least one aromatic aldehyde in an amount effective as a brightening agent.

29. The electroplating method of claim 18 wherein said bath contains at least one compound selected from the group consisting of NaOH, KOH, $Na_2CO_3$ and $K_2CO_3$ in an amount of 1 to 300 g/liter.

30. The electroplating method of claim 18 wherein zinc is added as a component selected from the group consisting of at least one ZnO, $ZnSO_47H_2O$, $ZnCO_3$ and $Zn(CH_3COO)_2$ in an amount of 1 to 70 g/liter of zinc, and said nickel is added as a component from the group consisting of $NiSO_46H_2O$, $NiCO_3$ and $(NH_4)_2Ni(SO_4)_26H_2O$ in an amount of 0.6 to 118 g/liter of nickel.

31. The electroplating method of claim 18 wherein said pH is at least 14.

32. The electroplating method of claim 18 wherein said bath consists essentially of water, about 1 to 70 grams/liter of zinc, about 0.6 to 118 grams/liter of nickel, and at least one compound from the group consisting of (i) aliphatic amines in an amount not more than 16 grams/liter, said bath having a pH of more than 11.

33. The electroplating method of claim 18 wherein said bath consists essentially of water, about 1 to 70 grams/liter of zinc, about 0.6 to 118 grams/liter of nickel, and at least one compound from the group consisting of (ii) polymers of aliphatic amines in an amount not more than about 20 grams/liter, said bath having a pH of more than 11.

34. The electroplating method of claim 18 wherein said bath consists essentially of water, about 1 to 70 grams/liter of zinc, about 0.6 to 118 grams/liter of nickel, (i) aliphatic amines in an amount not more than 16 grams/liter and (ii) polymers of aliphatic amines in an amount not more than about 20 grams/liter, said bath having a pH of more than 11.

35. The electroplating method of claim 18 wherein said bath consists essentially of water, about 1 to 70 grams/liter of zinc, about 0.6 to 118 grams/liter of nickel, at least one amine compound from the group consisting of (i) aliphatic amines in an amount not more than 16 grams/liter and (ii) polymers of aliphatic amines in an amount not more than about 20 grams/liter, and a compound from the group consisting of (iii) hydroxyaliphatic carboxylic acids and salts thereof in an amount from 0.01 to 2 mols/liter, said bath having a pH of more than 11.

36. The electroplating method for forming a chromate coating on a zinc-nickel alloy coating deposited electrolytically on electrically conductive metallic matrix material comprising electrolytically depositing a zinc-nickel coating on the matrix material from an electroplating bath consisting essentially of water, about 1 to 70 grams/liter of zinc, about 0.6 to 118 grams per liter of nickel, at least one component from the group consisting of (i) aliphatic amines in an amount not more than 16 grams/liter, (ii) polymers of aliphatic amines in an amount not more than about 20 grams per liter and (iii) a compound selected from the group consisting of hydroxyaliphatic carboxylic acids and salts thereof in amount not more than 2 mols/liter, said at least one component being in an effective amount so that the electrodeposited zinc-nickel alloy coating electrodeposited from said bath has a substantially uniform zinc-nickel alloy ratio, said bath having a pH of more than 11, and forming a chromate coating on the zinc-nickel alloy coating by means of a chromate treatment.

37. The electroplating method of claim 36 wherein said metallic matrix is selected from the group consisting of steel, copper, copper alloys and aluminum alloys.

38. An electroplating bath for forming a zinc-nickel alloy coating consisting essentially of water, about 1 to 70 grams/liter of zinc, about 0.6 to 118 grams per liter of nickel, at least one component from the group consisting of (i) aliphatic amines in an amount not more than 16 grams/liter, (ii) polymers of aliphatic amines in an amount not more than about 20 grams per liter and (iii) a compound selected from the group consisting of hydroxyaliphatic carboxylic acids and salts thereof in an amount not more than 2 mols/liter, said at least one component being in an effective amount so that the electrodeposited zinc-nickel alloy coating electrodeposited from said bath has a substantially uniform zinc-nickel alloy ratio and said bath also contains at least one aromatic aldehyde in an amount effective as a brightening agent, said bath having a pH of more than 11.

39. The electroplating bath of claim 38 wherein the minimum amount of said aliphatic amines (i) or polymers thereof (ii) is 0.03 mol/liter and the minimum amount of said hydroxyaliphatic carboxylic acids or salts thereof is 0.01 mol/liter.

* * * * *

US004889602B1

REEXAMINATION CERTIFICATE (2726th)

United States Patent [19]

[11] B1 4,889,602

Oshima et al.

[45] Certificate Issued Nov. 14, 1995

[54] ELECTROPLATING BATH AND METHOD FOR FORMING ZINC-NICKEL ALLOY COATING

[75] Inventors: Katsuhide Oshima, Tokyo; Toshiaki Murai, Chiba; Hitoshi Sakurai, Matsudo; Shuji Igarashi, Hino; Haruo Hanagata, Ebina; Hidesato Igarashi, Tokyo, all of Japan

[73] Assignee: Dipsol Chemicals Co., Ltd., Tokyo, Japan

Reexamination Request:
No. 90/003,592, Oct. 7, 1994

Reexamination Certificate for:

| | |
|---|---|
| Patent No.: | **4,889,602** |
| Issued: | **Dec. 26, 1989** |
| Appl. No.: | **186,788** |
| Filed: | **Apr. 25, 1988** |

Related U.S. Application Data

[63] Continuation-in-part of Ser. No. 37,863, Apr. 13, 1987, abandoned.

[30] Foreign Application Priority Data

Apr. 14, 1986 [JP] Japan ..... 61-85253
Jun. 4, 1986 [JP] Japan ..... 61-129447

[51] Int. Cl.[6] ..... C25D 5/10; C25D 3/56; C25D 5/48

[52] U.S. Cl. ..... 205/176; 205/177; 205/180; 205/181; 205/246; 205/259

[58] Field of Search ..... 205/176, 177, 205/178, 180, 181, 246, 255, 259

[56] References Cited

PUBLICATIONS

Ryabchenkov et al., Translated from Zhurnal Prikladnoi Khimii, vol. 47, No. 7 (Jul. 1974), pp. 1553–1558, 1594–1598.

Kotani et al., "Research on Complexing Agents for Alkaline Zn–Ni Alloy Plating Bath", Lecture Abstracts, Oct. 1984, pp. 1–6.

*Primary Examiner*—John F. Niebling

[57] ABSTRACT

The invention provides an electroplating bath for forming a zinc-nickel alloy coating consisting essentially of water, about 1 to 70 grams/liter of zinc, about 0.6 to 118 grams per liter of nickel, at least one compound from the group consisting of (i) aliphatic amines in an amount not more than 16 grams/liter, (ii) polymers of aliphatic amines in an amount not more than about 20 grams per liter and (iii) a compound selected from the group consisting of hydroxy-aliphatic carboxylic acids and salts thereof in an amount from 0 to 2 mols/liter, said bath having a pH of more than 11. The invention also provides an electroplating method for forming a chromate coating on a zinc-nickel alloy coating electrolytically deposited from the electroplating bath defined in the preceding sentence on electrically conductive metalics matrix material, and forming a chromate coating on the zinc-nickel alloy coating by means of a chromate treatment.

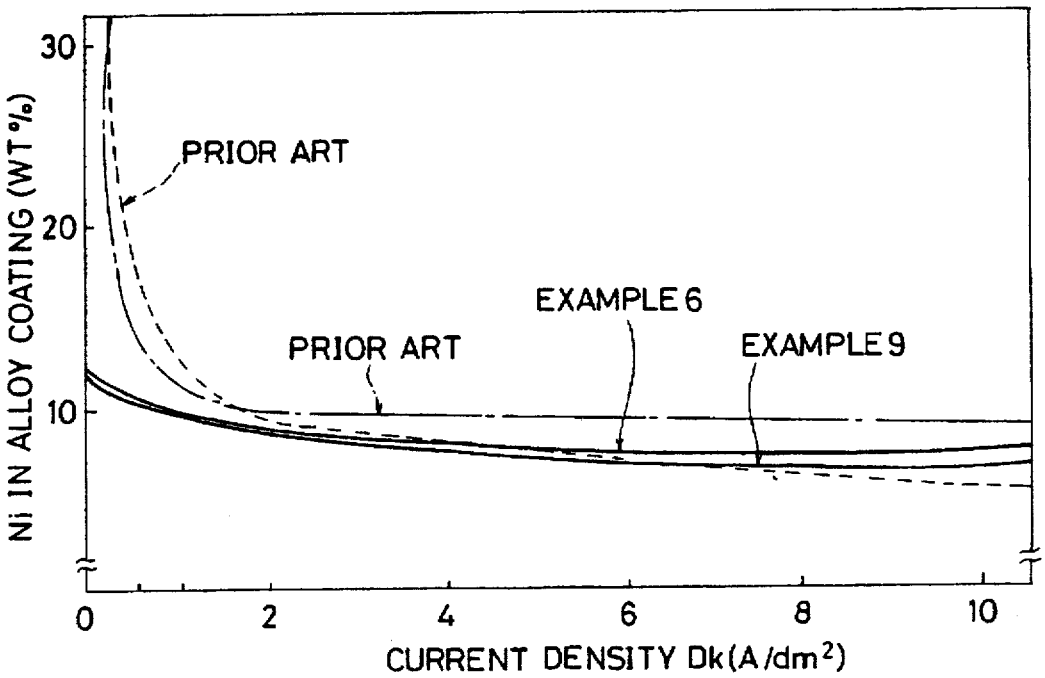

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1–39 are cancelled.

New claims 40–64 are added and determined to be patentable.

*40. An electroplating bath for forming a zinc-nickel alloy coating consisting essentially of:*

*a. water,*

*b. about 1 to 70 grams/liter of zinc,*

*c. about 0.6 to 118 grams/liter of nickel,*

*d. at least one component selected from the group consisting of:*

*(i) aliphatic amines in an amount not more than 16 grams/liter, and*

*(ii) polymers of aliphatic amines in an amount not more than about 20 grams per liter,*

*said at least one component being in an amount so that the electrodeposited zinc-nickel alloy coating electrodeposited from said bath has a substantially uniform zinc-nickel alloy ratio, and*

*e. at least one hydroxyaliphatic carboxylic acid selected from the group consisting of tartaric acid, sodium tartrate, citric acid, sodium citrate, disodium citrate, glycolic acid, sodium glycolate, and a salt thereof in an amount of from 0.01 to 2 mols/liter,*

*said bath having a pH of more than 11.*

*41. An electroplating bath for forming a zinc-nickel alloy coating consisting essentially of:*

*a. water,*

*b. about 1 to 70 grams/liter of zinc,*

*c. about 0.6 to 118 grams/liter of nickel,*

*d. at least one component selected from the group consisting of:*

*(i) aliphatic amines in an amount not more than 16 grams/liter, and*

*(ii) polymers of aliphatic amines in an amount not more than about 20 grams per liter,*

*said at least one component being in an amount so that the electrodeposited zinc-nickel alloy coating electrodeposited from said bath has a substantially uniform zinc-nickel alloy ratio, and*

*e. at least one hydroxyaliphatic carboxylic acid selected from the group consisting of tartaric acid, sodium tartrate, citric acid, sodium citrate, disodium citrate, glycolic acid, sodium glycolate, and a salt thereof in an amount of from 0.01 to 2 mols/liter,*

*said bath having a pH of more than 11,*

*wherein said bath contains at least one compound selected from the group consisting of NaOH, KOH, $Na_2CO_3$ and $K_2CO_3$ in an amount of 1 to 300 g/liter; and*

*wherein said at least one aliphatic amine is selected from the group consisting of monoethanolamine, diethanolamine, triethanolamine, ethylenediamine, diethylenetriamine, imino-bis-propylamine, triethylenetetramine, tetraethylenepentamine, hexamethylenediamine, N,N'-bis-(triaminopropyl)ethylenediamine, and a polymer thereof.*

*42. An electroplating bath for forming a zinc-nickel alloy coating consisting essentially of:*

*a. water,*

*b. about 1 to 70 grams/liter of zinc,*

*c. about 0.6 to 118 grams/liter of nickel,*

*d. at least one component selected from the group consisting of:*

*(i) aliphatic amines in an amount not more than 16 grams/liter, and*

*(ii) polymers of aliphatic amines in an amount not more than about 20 grams per liter,*

*said at least one component being in an amount so that the electrodeposited zinc-nickel alloy coating electrodeposited from said bath has a substantially uniform zinc-nickel alloy ratio, and*

*e. at least one hydroxyaliphatic carboxylic acid selected from the group consisting of tartaric acid, sodium tartrate, citric acid, sodium citrate, disodium citrate, glycolic acid, sodium glycolate, and a salt thereof in an amount of from 0.01 to 2 mols/liter,*

*said bath having a pH of more than 11,*

*wherein said bath contains at least one compound selected from the group consisting of NaOH, KOH, $Na_2CO_3$ and $K_2CO_3$ in an amount of 1 to 300 g/liter; and*

*wherein said at least one aliphatic amine is selected from the group consisting of monoethanolamine, diethanolamine, triethanolamine, ethylenediamine, diethylenetriamine, imino-bis-propylamine, triethylenetetramine, tetraethylenepentamine, hexamethylenediamine, N,N'-bis-(triaminopropyl)ethylenediamine, and a polymer thereof, and*

*wherein said bath also contains at least one aromatic aldehyde as a brightening agent.*

*43. An electroplating bath for forming a zinc-nickel alloy coating consisting essentially of:*

*a. water,*

*b. about 1 to 70 grams/liter of zinc,*

*c. about 0.6 to 118 grams/liter of nickel,*

*d. at least one component selected from the group consisting of:*

*(i) aliphatic amines in an amount not more than 16 grams/liter, and*

*(ii) polymers of aliphatic amines in an amount not more than about 20 grams per liter,*

*said at least one component being in an amount so that the electrodeposited zinc-nickel alloy coating electrodeposited from said bath has a substantially uniform zinc-nickel alloy ratio, and*

*e. at least one hydroxyaliphatic carboxylic acid selected from the group consisting of tartaric acid, sodium tartrate, citric acid, sodium citrate, disodium citrate, glycolic acid, sodium glycolate, and a salt thereof in an amount of from 0.01 to 2 mols/liter,*

*wherein said bath contains at least one compound*

*selected from the group consisting of NaOH, KOH, $Na_2CO_3$ and $K_2CO_3$ in an amount of 1 to 300 g/liter; and*

*wherein said at least one aliphatic amine is selected from the group consisting of monoethanolamine, diethanolamine, triethanolamine, ethylenediamine, diethylenetriamine, imino-bis-propylamine, triethylenetetramine, tetraethylenepentamine, hexamethylenediamine, N,N'-bis-(triaminopropyl)ethylenediamine, and a polymer thereof, and*

*wherein said bath also contains at least one aromatic aldehyde as a brightening agent, and*

*wherein said bath has a pH of 14.*

*44. An electroplating bath for forming a zinc-nickel alloy coating consisting essentially of:*

*a. water,*

*b. about 1 to 70 grams/liter of zinc,*

*c. about 0.6 to 118 grams/liter of nickel,*

*d. at least one component selected from the group consisting of:*

*(i) aliphatic amines in an amount not more than 16 grams/liter, and*

*(ii) polymers of aliphatic amines in an amount not more than about 20 grams per liter,*

*said at least one component being in an amount so that the electrodeposited zinc-nickel alloy coating electrodeposited from said bath has a substantially uniform zinc-nickel alloy ratio, and*

*e. at least one hydroxyaliphatic carboxylic acid selected from the group consisting of tartaric acid, sodium tartrate, citric acid, sodium citrate, disodium citrate, glycolic acid, sodium glycolate, and a salt thereof in an amount of from 0.01 to 2 mols/liter,*

*wherein said bath contains at least one compound selected from the group consisting of NaOH, KOH, $Na_2CO_3$ and $K_2CO_3$ in an amount of 1 to 300 g/liter; and*

*wherein said at least one aliphatic amine is selected from the group consisting of monoethanolamine, diethanolamine, triethanolamine, ethylenediamine, diethylenetriamine, imino-bis-propylamine, triethylenetetramine, tetraethylenepentamine, hexamethylenediamine, N,N'-bis-(triaminopropyl)ethylenediamine, and a polymer thereof, and*

*wherein said bath also contains at least one aromatic aldehyde as a brightening agent, and*

*wherein said bath has a pH of 14, and*

*wherein said zinc is added as a component selected from the group consisting of ZnO, $ZnSO_47H_2O$, $ZnCO_3$ and $Zn(CH_3COO)_2$, and said nickel is added as a component from the group consisting of $NiSO_46H_2O$, $NiCO_3$ and $(NH_4)_2Ni(SO_4)_26H_2O$.*

*45. An electroplating bath for forming a zinc-nickel alloy coating consisting essentially of:*

*a. water,*

*b. about 1 to 70 grams/liter of zinc,*

*c. about 0.6 to 118 grams/liter of nickel,*

*d. at least one component selected from the group consisting of:*

*(i) aliphatic amines in an amount not more than 16 grams/liter, and*

*(ii) polymers of aliphatic amines in an amount not more than about 20 grams per liter,*

*said at least one component being in an amount so that the electrodeposited zinc-nickel alloy coating electrodeposited from said bath has a substantially uniform zinc-nickel alloy ratio, and*

*e. at least one hydroxyaliphatic carboxylic acid selected from the group consisting of tartaric acid, sodium tartrate, citric acid, sodium citrate, disodium citrate, glycolic acid, sodium glycolate, and a salt thereof in an amount of from 0.01 to 2 mols/liter,*

*said bath having a pH of more than 11, and*

*wherein the minimum amount of said aliphatic amines (i) or polymers of aliphatic amines (ii) is 0.03 mol/liter.*

*46. An electroplating bath for forming a zinc-nickel alloy coating consisting essentially of:*

*a. water,*

*b. about 1 to 70 grams/liter of zinc,*

*c. about 0.6 to 118 grams/liter of nickel,*

*d. at least one aliphatic amine selected from the group consisting of monoethanolamine, diethanolamine, triethanolamine, ethylenediamine, diethylenetriamine, imino-bis-propylamine, triethylenetetramine, tetraethylenepentamine, hexamethylenediamine, and N,N'-bis-(triaminopropyl)ethylenediamine in an amount not more than 16 grams/liter or a polymer thereof in an amount not more than about 20 grams per liter, said at least one aliphatic amine being in an amount so that the electrodeposited zinc-nickel alloy coating electrodeposited from said bath has a substantially uniform zinc-nickel alloy ratio,*

*said bath having a pH of more than 11.*

*47. An electroplating bath for forming a zinc-nickel alloy coating consisting essentially of:*

*a. water,*

*b. about 1 to 70 grams/liter of zinc,*

*c. about 0.6 to 118 grams/liter of nickel,*

*d. at least one amine component selected from the group consisting of:*

*(i) aliphatic amines in an amount not more than 16 grams/liter, and*

*(ii) polymers of aliphatic amines in an amount not more than about 20 grams per liter,*

*said at least one component being in an amount so that the electrodeposited zinc-nickel alloy coating electrodeposited from said bath has a substantially uniform zinc-nickel alloy ratio, and*

*e. at least one aromatic aldehyde as a brightening agent,*

*said bath having a pH of more than 11.*

*48. An electroplating bath for forming a zinc-nickel alloy coating consisting essentially of:*

*a. water,*

*b. a zinc component selected from the group consisting of ZnO, $ZnSO_47H_2O$, $ZnCO_3$ and $Zn(CH_3COO)_2$ in an amount of 1 to 70 grams of zinc per liter,*

*c. a nickel component selected from the group consisting of $NiSO_46H_2O$, $NiCO_3$ and $(NH_4)_2Ni(SO_4)_26H_2O$ in an amount of 0.6 to 118 grams of nickel per liter,*

*d. at least one component selected from the group consisting of:*

*(i) aliphatic amines in an amount not more than 16 grams/liter, and*

*(ii) polymers of aliphatic amines in an amount not more than about 20 grams per liter,*

*said at least one component being in an amount so that the electrodeposited zinc-nickel alloy coating electrodeposited from said bath has a substantially uni-*

*form zinc-nickel alloy ratio,*

*said bath having a pH of more than 11.*

*49. An electroplating bath for forming a zinc-nickel alloy coating consisting essentially of:*

*a. water,*

*b. about 1 to 70 grams/liter of zinc,*

*c. about 0.6 to 118 grams/liter of nickel,*

*d. at least one component selected from the group consisting of:*

*(i) aliphatic amines in an amount not more than 16 grams/liter, and*

*(ii) polymers of aliphatic amines in an amount not more than about 20 grams per liter,*

*said at least one component being in an amount so that the electrodeposited zinc-nickel alloy coating electrodeposited from said bath has a substantially uniform zinc-nickel alloy ratio,*

*said bath having a pH of at least 14.*

*50. An electroplating bath for forming a zinc-nickel alloy coating consisting essentially of:*

*a. water,*

*b. about 1 to 70 grams/liter of zinc,*

*c. about 0.6 to 118 grams/liter of nickel,*

*d. aliphatic amines in an amount not more than 16 grams/liter, and*

*e. polymers of aliphatic amines in an amount not more than about 20 grams per liter,*

*in an amount so that the electrodeposited zinc-nickel alloy coating electrodedeposited from said bath has a substantially uniform zinc-nickel alloy ratio, said bath having a pH of at least 11.*

*51. The electroplating method for forming a zinc-nickel alloy coating on an electrically conductive metallic matrix material comprising electrolytically depositing a zinc-nickel alloy coating on the matrix material from an electroplating bath consisting essentially of:*

*a. water,*

*b. about 1 to 70 grams/liter of zinc,*

*c. about 0.6 to 118 grams/liter of nickel,*

*d. at least one compound selected from the group consisting of NaOH, KOH, $Na_2CO_3$ and $K_2CO_3$ in an amount of 1 to 300 g/liter,*

*e. at least 0.03 mol per liter of at least one aliphatic amine selected from the group consisting of monoethanolamine, diethanolamine, triethanolamine, ethylenediamine, diethylenetriamine, imino-bis-propylamine, triethylenetetramine, tetraethylenepentamine, hexamethylenediamine, N,N'-bis-(triaminopropyl)ethylenediamine, and a polymer thereof, and*

*f. at least 0.01 mol/liter of a hydroxyaliphatic carboxylic acid selected from the group consisting of tartaric acid, sodium tartrate, citric acid, sodium citrate, disodium citrate, glycolic acid, sodium glycolate, and a salt thereof,*

*said bath having a pH of more than 11.*

*52. The electroplating method for forming a zinc-nickel alloy coating on an electrically conductive metallic matrix material comprising electrolytically depositing a zinc-nickel alloy coating on the matrix material from an electroplating bath consisting essentially of:*

*a. water,*

*b. about 1 to 70 grams/liter of zinc,*

*c. about 0.6 to 118 grams/liter of nickel,*

*d. at least one compound selected from the group consisting of NaOH, KOH, $Na_2CO_3$ and $K_2CO_3$ in an amount of 1 to 300 g/liter,*

*e. at least 0.03 mol per liter of at least one aliphatic amine selected from the group consisting of monoethanolamine, diethanolamine, triethanolamine, ethylenediamine, diethylenetriamine, imino-bis-propylamine, triethylenetetramine, tetraethylenepentamine, hexamethylenediamine, N,N'-bis-(triaminopropyl)ethylenediamine, and a polymer thereof, and*

*f. at least 0.01 mol/liter of a hydroxyaliphatic carboxylic acid selected from the group consisting of tartaric acid, sodium tartrate, citric acid, sodium citrate, disodium citrate, glycolic acid, sodium glycolate, and a salt thereof,*

*said bath having a pH of more than 11,*

*wherein said bath also contains at least one aromatic aldehyde as a brightening agent.*

*53. The electroplating method for forming a zinc-nickel alloy coating on an electrically conductive metallic matrix material comprising electrolytically depositing a zinc-nickel alloy coating on the matrix material from an electroplating bath consisting essentially of:*

*a. water,*

*b. about 1 to 70 grams/liter of zinc,*

*c. about 0.6 to 118 grams/liter of nickel,*

*d. at least one compound selected from the group consisting of NaOH, KOH, $Na_2CO_3$ and $K_2CO_3$ in an amount of 1 to 300 g/liter,*

*e. at least 0.03 mol per liter of at least one aliphatic amine selected from the group consisting of monoethanolamine, diethanolamine, triethanolamine, ethylenediamine, diethylenetriamine, imino-bis-propylamine, triethylenetetramine, tetraethylenepentamine, hexamethylenediamine, N,N'-bis-(triaminopropyl)ethylenediamine, and a polymer thereof, and*

*f. at least 0.01 mol/liter of a hydroxyaliphatic carboxylic acid selected from the group consisting of tartaric acid, sodium tartrate, citric acid, sodium citrate, disodium citrate, glycolic acid, sodium glycolate, and a salt thereof,*

*wherein said bath also contains at least one aromatic aldehyde as a brightening agent, and*

*wherein said bath has a pH of 14.*

*54. The electroplating method for forming a zinc-nickel alloy coating on an electrically conductive metallic matrix material comprising electrolytically depositing a zinc-nickel alloy coating on the matrix material from an electroplating bath consisting essentially of:*

*a. water,*

*b. about 1 to 70 grams/liter of zinc,*

*c. about 0.6 to 118 grams/liter of nickel,*

*d. at least one compound selected from the group consisting of NaOH, KOH, $Na_2CO_3$ and $K_2CO_3$ in an amount of 1 to 300 g/liter,*

*e. at least 0.03 mol per liter of at least one aliphatic amine selected from the group consisting of monoethanolamine, diethylamine, triethanolamine, ethylenediamine, diethylenetriamine, imino-bis-propylamine, triethylenetetramine, tetraethylenepentamine, hexamethylenediamine, N,N'-bis-(triaminopropyl)ethylenediamine, and a polymer thereof, and*

*f. at least 0.01 mol/liter of a hydroxyaliphatic carboxylic acid selected from the group consisting of tartaric acid,*

*sodium tartrate, citric acid, sodium citrate, disodium citrate, glycolic acid, sodium glycolate, and a salt thereof,*

*wherein said bath also contains at least one aromatic adhehyde as a brightening agent, and*

*wherein said bath has a pH of 14, and*

*wherein said zinc is added as a component selected from the group consisting of ZnO, $ZnSO_47H_2O$, $ZnCO_3$ and $Zn(CH_3COO)_2$, and said nickel is added as a component from the group consisting of $NiSO_46H_2O$, $NiCO_3$ and $(NH_4)_2Ni(SO_4)_26H_2O$.*

*55. The electroplating method for forming a zinc-nickel alloy coating on an electrically conductive metallic matrix material comprising electrolytically depositing a zinc-nickel alloy coating on the matrix material from an electroplating bath consisting essentially of;*

*a. water,*

*b. about 1 to 70 grams/liter of zinc,*

*c. about 0.6 to 118 grams/liter of nickel,*

*d. at least one component selected from the group consisting of:*

*(i) aliphatic amines in an amount not more than 16 grams/liter,*

*(ii) polymers of aliphatic amines in an amount not more than about 20 grams per liter, and*

*(iii) a compound selected from the group consisting of hydroxyaliphatic carboxylic acids and salts thereof in amount not more than 2 mols/liter,*

*said at least one component being in an amount so that the electrodeposited zinc-nickel alloy coating electrodeposited from said bath has a substantially uniform zinc-nickel alloy ratio, and*

*e. at least one aromatic aldehyde as a brightening agent,*

*said bath having a pH of more than 11.*

*56. The electroplating method for forming a zinc-nickel alloy coating on an electrically conductive metallic matrix material comprising electrolytically depositing a zinc-nickel alloy coating on the matrix material from an electroplating bath consisting essentially of:*

*a. water,*

*b. a zinc component selected from the group consisting of ZnO, $ZnSO_47H_2O$, $ZnCO_3$ and $Zn(CH_3COO)_2$ in an amount of 1 to 70 grams of zinc per liter,*

*c. a nickel component selected from the group consisting of $NiSO_46H_2O$, $NiCO_3$ and $(NH_4)_2Ni(SO_4)_26H_2O$ an in amount of 0.6 to 118 grams of nickel per liter,*

*d. at least one component selected from the group consisting of:*

*(i) aliphatic amines in an amount not more than 16 grams/liter,*

*(ii) polymers of aliphatic amines in an amount not more than about 20 grams per liter, and*

*(iii) a compound selected from the group consisting of hydroxyaliphatic carboxylic acids and salts thereof in amount not more than 2 mols/liter,*

*said at least one component being in an amount so that the electrodeposited zinc-nickel alloy coating electrodeposited from said bath has a substantially uniform zinc-nickel alloy ratio,*

*said bath having a pH of more than 11.*

*57. The electroplating method for forming a zinc-nickel alloy coating on an electrically conductive metallic matrix material comprising electrolytically depositing a zinc-nickel alloy coating on the matrix material from an electroplating bath consisting essentially of:*

*a. water,*

*b. about 1 to 70 grams/liter of zinc,*

*c. about 0.6 to 118 grams/liter of nickel,*

*d. at least one component selected from the group consisting of:*

*(i) aliphatic amines in an amount not more than 16 grams/liter,*

*(ii) polymers of aliphatic amines in an amount not more than about 20 grams per liter, and*

*(iii) a compound selected from the group consisting of hydroxyaliphatic carboxylic acids and salts thereof in amount not more than 2 mols/liter,*

*said at least one component being in an amount so that the electrodeposited zinc-nickel alloy coating electrodeposited from said bath has a substantially uniform zinc-nickel alloy ratio,*

*said bath having a pH of at least 14.*

*58. The electroplating method for forming a zinc-nickel alloy coating on an electrically conductive metallic matrix material comprising electrolytically depositing a zinc-nickel alloy coating on the matrix material from an electroplating bath consisting essentially of:*

*a. water,*

*b. about 1 to 70 grams/liter of zinc,*

*c. about 0.6 to 118 grams/liter of nickel,*

*d. at least one aliphatic amine in an amount not more than 16 grams/liter,*

*e. at least one polymer of aliphatic amines in an amount not more than about 20 grams per liter, and*

*f. optionally, a compound selected from the group consisting of hydroxyaliphatic carboxylic acids and salts thereof in amount not more than 2 mols/liter,*

*wherein said aliphatic amine, polymer of aliphatic amine and optional hydroxyaliphatic carboxylic acid or salt are present in an amount so that the electrodeposited zinc-nickel alloy coating electrodeposited from said bath has a substantially uniform zinc-nickel alloy ratio,*

*said bath having a pH of more than 11.*

*59. The electroplating method for forming a zinc-nickel alloy coating on an electrically conductive metallic matrix material comprising electrolytically depositing a zinc-nickel alloy coating on the matrix material from an electroplating bath consisting essentially of:*

*a. water,*

*b. about 1 to 70 grams/liter of zinc,*

*c. about 0.6 to 118 grams/liter of nickel,*

*d. at least one amine component selected from the group consisting of:*

*(i) aliphatic amines in an amount not more than 16 grams/liter, and*

*(ii) polymers of aliphatic amines in an amount not more than about 20 grams per liter, and*

*e. a compound selected from the group consisting of hydroxyaliphatic carboxylic acids and salts thereof in amount from 0.01 to 2 mols/liter,*

*wherein the electrodeposited zinc-nickel alloy coating electrodeposited from said bath has a substantially uniform zinc-nickel alloy ratio,*

*said bath having a pH of more than 11.*

*60. The electroplating method for forming a chromate coating on a zinc-nickel alloy coating deposited electrolytically on electrically conductive metallic matrix material comprising electrolytically depositing a zinc-nickel alloy coating on the matrix material from an electroplating bath*

*consisting essentially of:*

*a. water,*

*b. about 1 to 70 grams/liter of zinc,*

*c. about 0.6 to 118 grams/liter of nickel,*

*d. at least one component selected from the group consisting of:*

*(i) aliphatic amines in an amount not more than 16 grams/liter,*

*(ii) polymers of aliphatic amines in an amount not more than about 20 grams per liter, and*

*(iii) a compound selected from the group consisting of hydroxyaliphatic carboxylic acids and salts thereof in amount not more than 2 mols/liter,*

*said at least one component being in an amount so that the electrodeposited zinc-nickel alloy coating electrodeposited from said bath has a substantially uniform zinc-nickel alloy ratio,*

*said bath having a pH of more than 11, and*

*forming a chromate coating on the zinc-nickel alloy coating by means of a chromate treatment.*

*61. The electroplating method for forming a chromate coating on a zinc-nickel alloy coating deposited electrolytically on electrically conductive metallic matrix material comprising electrolytically depositing a zinc-nickel alloy coating on the matrix material from an electroplating bath consisting essentially of:*

*a. water,*

*b. about 1 to 70 grams/liter of zinc,*

*c. about 0.6 to 118 grams/liter of nickel,*

*d. at least one component selected from the group consisting of:*

*(i) aliphatic amines in an amount not more than 16 grams/liter,*

*(ii) polymers of aliphatic amines in an amount not more than about 20 grams per liter, and*

*(iii) a compound selected from the group consisting of hydroxyaliphatic carboxylic acids and salts thereof in amount not more than 2 mols/liter,*

*said at least one component being in an amount so that the electrodeposited zinc-nickel alloy coating electrodeposited from said bath has a substantially uniform zinc-nickel alloy ratio,*

*said bath having a pH of more than 11, and*

*forming a chromate coating on the zinc-nickel alloy coating by means of a chromate treatment, and*

*wherein said metallic matrix is selected from the group consisting of steel, copper, copper alloys and aluminum alloys.*

*62. An electroplating bath for forming a zinc-nickel alloy consisting essentially of:*

*a. water,*

*b. about 1 to 70 grams/liter of zinc,*

*c. about 0.6 to 118 grams/liter of nickel,*

*d. at least one component selected from the group consisting of:*

*(i) aliphatic amines in an amount not more than 16 grams/liter,*

*(ii) polymers of aliphatic amines in an amount not more than about 20 grams per liter, and*

*(iii) a compound selected from the group consisting of hydroxyaliphatic carboxylic acids and salts thereof in amount not more than 2 mols/liter,*

*said at least one component being in an amount so that the electrodeposited zinc-nickel alloy coating electrodeposited from said bath has a substantially uniform zinc-nickel alloy ratio, and*

*wherein said bath contains at least one aromatic aldehyde as a brightening agent, and*

*said bath having a pH of more than 11.*

*63. An electroplating bath for forming a zinc-nickel alloy coating consisting essentially of:*

*a. water,*

*b. about 1 to 70 grams/liter of zinc,*

*c. about 0.6 to 118 grams/liter of nickel,*

*d. at least one component selected from the group consisting of:*

*(i) aliphatic amines in an amount not more than 16 grams/liter,*

*(ii) polymers of aliphatic amines in an amount not more than about 20 grams per liter, and*

*(iii) a compound selected from the group consisting of hydroxyaliphatic carboxylic acids and salts thereof in amount not more than 2 mols/liter,*

*said at least one component being in an amount so that a zinc-nickel alloy coating electrodeposited from said bath has a substantially uniform zinc-nickel alloy ratio, and*

*wherein said bath contains at least one aromatic aldehyde as a brightening agent,*

*said bath having a pH of more than 11, and*

*wherein the minimum amount of said aliphatic amines (i) or polymers of aliphatic amines (ii) is 0.03 mol/liter and the minimum amount of said hydroxyaliphatic carboxylic acids or salts thereof is 0.01 mol/liter.*

*64. An electroplating bath for forming a zinc-nickel alloy coating consisting essentially of:*

*a. water,*

*b. about 1 to 70 grams/liter of zinc,*

*c. about 0.6 to 118 grams/liter of nickel,*

*d. aliphatic amines in an amount not more than 16 grams/liter,*

*e. polymers of aliphatic amines in an amount not more than about 20 grams per liter,*

*wherein said aliphatic amines and polymer of aliphatic amines are present in an amount so that a zinc-nickel alloy coating electrodeposited from said bath has a substantially uniform zinc-nickel alloy ratio, and*

*f. at least one hydroxyaliphatic carboxylic acid selected from the group consisting of tartaric acid, sodium tartrate, citric acid, sodium citrate, disodium citrate, glycolic acid, sodium glycolate, and a salt thereof in an amount of from 0.01 to 2 mols/liter,*

*said bath having a pH of more than 11.*

* * * * *